US009670631B2

(12) United States Patent
Ditta et al.

(10) Patent No.: US 9,670,631 B2
(45) Date of Patent: Jun. 6, 2017

(54) VEHICLE AND PERSONAL BARRIER FOR CONSTRUCTION SITE

(71) Applicants: Paul L. Ditta, Gormley (CA); Vito Ditta, Gormley (CA); Joseph Ditta, Gormley (CA)

(72) Inventors: Paul L. Ditta, Gormley (CA); Vito Ditta, Gormley (CA); Joseph Ditta, Gormley (CA)

( * ) Notice: Subject to any disclaimer, the term of this patent is extended or adjusted under 35 U.S.C. 154(b) by 0 days.

(21) Appl. No.: 14/756,761

(22) Filed: Oct. 9, 2015

(65) Prior Publication Data

US 2017/0101751 A1 Apr. 13, 2017

Related U.S. Application Data

(63) Continuation-in-part of application No. 13/986,755, filed on Jun. 3, 2013, now abandoned.

(51) Int. Cl.
*E01F 13/02* (2006.01)

(52) U.S. Cl.
CPC ..... *E01F 13/022* (2013.01)

(58) Field of Classification Search
CPC ..... E01F 15/083; E01F 15/08; E01F 15/088; E01F 15/086; E01F 15/02; E01F 15/006; E01F 9/087
See application file for complete search history.

(56) References Cited

U.S. PATENT DOCUMENTS 3,114,303 A * 12/1963 Oberbach ..... E01F 7/06 256/13.1
3,388,892 A * 6/1968 Case ..... E01D 19/103 256/13.1
4,138,095 A 2/1979 Humphrey
4,406,563 A 9/1983 Urlberger
4,685,656 A * 8/1987 Lee ..... E01F 15/025 256/13.1
4,751,893 A * 6/1988 Brantley ..... E01F 7/06 116/63 R
5,015,119 A * 5/1991 Schmanski ..... E01F 7/06 256/13.1
5,022,781 A 6/1991 Smith
5,149,061 A * 9/1992 Borgnini ..... E01F 7/06 256/13.1
5,181,695 A * 1/1993 Arthur ..... E01F 7/06 256/13.1
5,186,438 A * 2/1993 Cross ..... E01F 7/04 256/12.5
5,406,039 A * 4/1995 Rerup ..... E01F 8/0011 181/210
5,471,811 A 12/1995 House et al.
(Continued)

FOREIGN PATENT DOCUMENTS

GB 1044 550 10/1966

*Primary Examiner* — Abigail A Risic

(57) ABSTRACT

A modular combined pedestrian and vehicle barrier for a construction site and having upright post members with retention channels, spaced apart from each other, vehicle barrier members of predetermined length and height and having supports at each end, engagable with the channels on the posts, an intermediate fence rail extending between the posts adjacent to the upper extremity of the vehicle barrier members, and, personal fence panels located between the posts, and extending above the intermediate fence rails.

5 Claims, 3 Drawing Sheets

(56) References Cited

U.S. PATENT DOCUMENTS

| | | | | | |
|---|---|---|---|---|---|
| 5,588,786 | A * | 12/1996 | House | E01F 8/0011 | 405/284 |
| 5,752,691 | A | 5/1998 | Basbon et al. | | |
| 6,149,338 | A * | 11/2000 | Anderson | E01F 8/0064 | 256/1 |
| 6,962,461 | B2 * | 11/2005 | Choi | E01F 7/06 | 256/13.1 |
| 7,104,720 | B2 * | 9/2006 | Humphries | E01F 8/0017 | 256/13.1 |
| 7,220,077 | B2 * | 5/2007 | Humphries | E01F 15/083 | 404/6 |
| 7,600,942 | B2 | 10/2009 | Yodock, III et al. | | |
| 7,618,212 | B2 * | 11/2009 | Yodock, III | E01F 15/083 | 404/6 |
| 7,950,871 | B2 | 5/2011 | Lass et al. | | |
| 8,001,880 | B2 * | 8/2011 | White | E01F 13/12 | 404/6 |
| 2005/0104054 | A1 * | 5/2005 | Humphries | E01F 8/0017 | 256/13.1 |
| 2005/0135878 | A1 | 6/2005 | McNally et al. | | |
| 2005/0265780 | A1 * | 12/2005 | Humphries | E01F 15/083 | 404/6 |
| 2008/0271652 | A1 * | 11/2008 | White | E01F 13/12 | 109/49.5 |
| 2009/0196688 | A1 * | 8/2009 | Park | E01F 7/06 | 404/6 |
| 2010/0171085 | A1 | 7/2010 | Webster, IV | | |
| 2012/0207541 | A1 * | 8/2012 | Maus | E01F 15/086 | 404/6 |
| 2014/0191174 | A1 * | 7/2014 | Ditta | E04G 21/3204 | 256/31 |
| 2014/0334875 | A1 * | 11/2014 | Hoffman | E01F 15/083 | 404/6 |

* cited by examiner

VEHICLE AND PERSONAL BARRIER FOR CONSTRUCTION SITE

FIELD OF THE INVENTION

This application is a Continuation in Part of application Ser. No. 13/986,755 filed Jun.3 2013, Title; VEHICLE AND PERSONAL BARRIER FOR CONSTRUCTION SITE, inventors' Paul L Ditta, Vito Ditta, and Joseph Ditta the priority of which is claimed The invention relates to a combination barrier for construction sites and in particular to an accident preventative barrier for protecting a site from accidents to both vehicles and pedestrians.

BACKGROUND OF THE INVENTION

Barriers for protecting construction sites are of a wide variety. In some cases, simple fences are erected. In other cases, elaborate barricades of plywood and overhead protection are provided. In some cases openings are provided at intervals for viewing by pedestrians.

Usually these barriers are erected on a custom basis on site. In many cases they use new lumber, and involve various trades. When the building is finished and they are no longer required, the fences are then scrapped.

These practices are clearly a waste of resources, and also pose problems for disposal. It is desirable to provide a modular barrier which can be erected around a construction site and which can be taken down and reused at another site. In this way, the barriers can be put up by unskilled labour, and the problems of disposing of waste material are eliminated.

Another problem also arises in connection with protecting construction sites, for example, protecting outsiders from unauthorised entry into the construction site and becoming injured.

Clearly pedestrian barriers are intended to protect pedestrians from accidents in the construction site, and to exclude unwanted intrusion.

However many construction sites are located close to road ways and highways, and the possibility of vehicles going out of control and plunging into the construction site are serious. It is therefore desirable to provide a modular combined barrier which both excludes pedestrians and also provides substantial protection against incursions by vehicles, where the components are modular and fit together, and have a unit size and length, making it simple to ship and erect and to dismantle once it is no longer needed, and can be reused again and again at various different sites.

There is shown in UK patent No 1044556, Wolfe a system the purpouse of which is to erect an anti dazzle material along motor ways, in random lengths, so that it can be erected along a pre-existing motorway crash barrier. The Wolfe anti dazzle is simply to be placed on the existing motor way crash barrier as an add on or afterthought. It is not modular. It does not have components consisting of precast concrete crash barriers, at ground level, and personal barriers above the crash barriers which a modular with the vehicle crash barriers and which can all be erected, used, and dismantled at various different sites, from time to time.

Another system is shown in U.S. Pat. No. 4,685,656. This system uses posts which are cylindrical tubes. Each crash barrier must be fastened to each pair of tubes by U-bolts. The personal fence is fastened by a series of cylindrical loops. This system is not modular. All the components must be tailor made for one use. This greatly adds to the cost. It also requires more detailed work in erection.

U.S. Pat. No. 5,757,691 shows a system in which concrete barriers are spaced apart. The space is occupied by barbed wire.

This would be dangerous as a vehicle barrier. It requires special custom made components, and special erection techniques.

U.S. Pat. No. 7,600,942, shows a system in which the concrete barriers must be specially fabricated so as to incorporate the side rails.

US patent appin 2005/0135878 shows a system in which the concrete barriers must be specially formed to accept through bolts.

In applicants invention the concrete barriers do not require any special manufacturing features. The posts support the ends of the barriers, and also support the modular personal panels above the barriers, all being supported by the posts which support first the modular concrete vehicle barriers, and then the modular pedestrian barriers as well.

BRIEF SUMMARY OF THE INVENTION

With a view to providing a combined pedestrian and vehicle barrier in a modular construction, the invention comprises a modular combined pedestrian and vehicle barrier construction site fence system and having a plurality of upright post members spaced apart, the members defining upper and lower ends; and having an H shaped transverse cross section, and pairs of retention side flanges defined by the H-shaped cross section, on opposite sides of the post members throughout their length ; base plates attached transversely to the lower ends of the post members adapted to be secured to the ground; pre cast concrete vehicle barrier members of predetermined length and height and defining predetermined upper edges ; end support connectors secured to each end of each pre cast concrete vehicle barrier member inter-engageable between respective pairs of the side flanges on the post memberss; an intermediate transverse fence rail extending between the post members adjacent to the upper edges of the pre cast concrete vehicle barrier members; the fence rail forming a downwardly open channel fitting over the upper edges of the pre cast concrete vehicle barrier members, and, modular personal fence panels located between the post members, and extending above the intermediate fence rails and above the pre cast concrete vehicle barrier members and having a length corresponding to the length of said pre cast barrier members, to fit between adjacent post members.

The invention further provides such a modular combined barrier wherein the personal barriers are further formed of wire mesh material supported in said frames, permitting pedestrians to view the work on the construction site.

The invention further provides such a combined barrier wherein said upright posts are have transverse base plates, adapted to be secured to the ground.

The invention further provides such a modular combined barrier wherein the precast concrete vehicle barrier members have end supports at each end of each said precast concrete barrier, and wherein each end support means inter engage with said side flanges on said upright post members.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
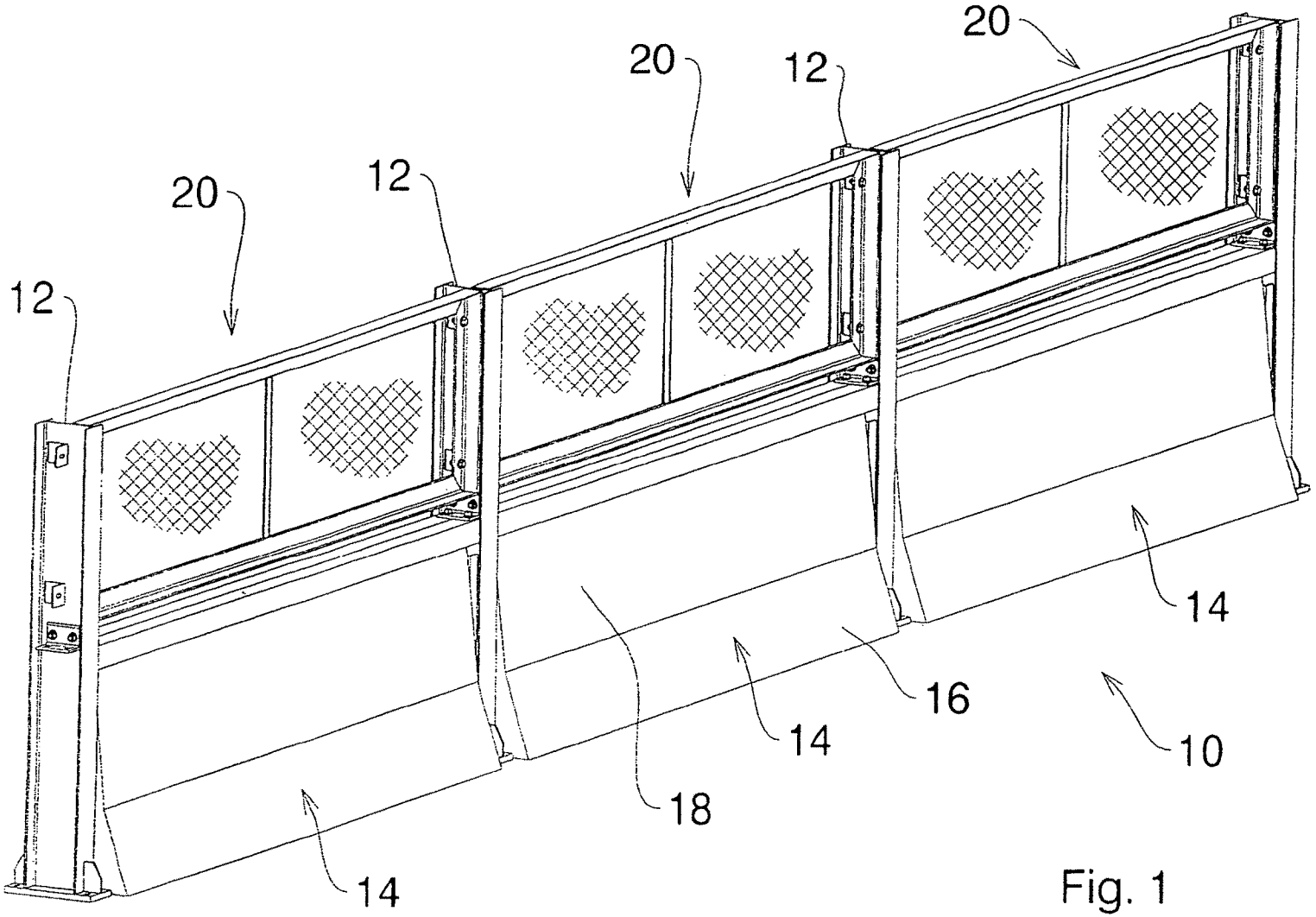
FIG. 1 is a perspective illustration of a portion of a typical construction site, illustrating the fence system of the invention.
Figure 2:
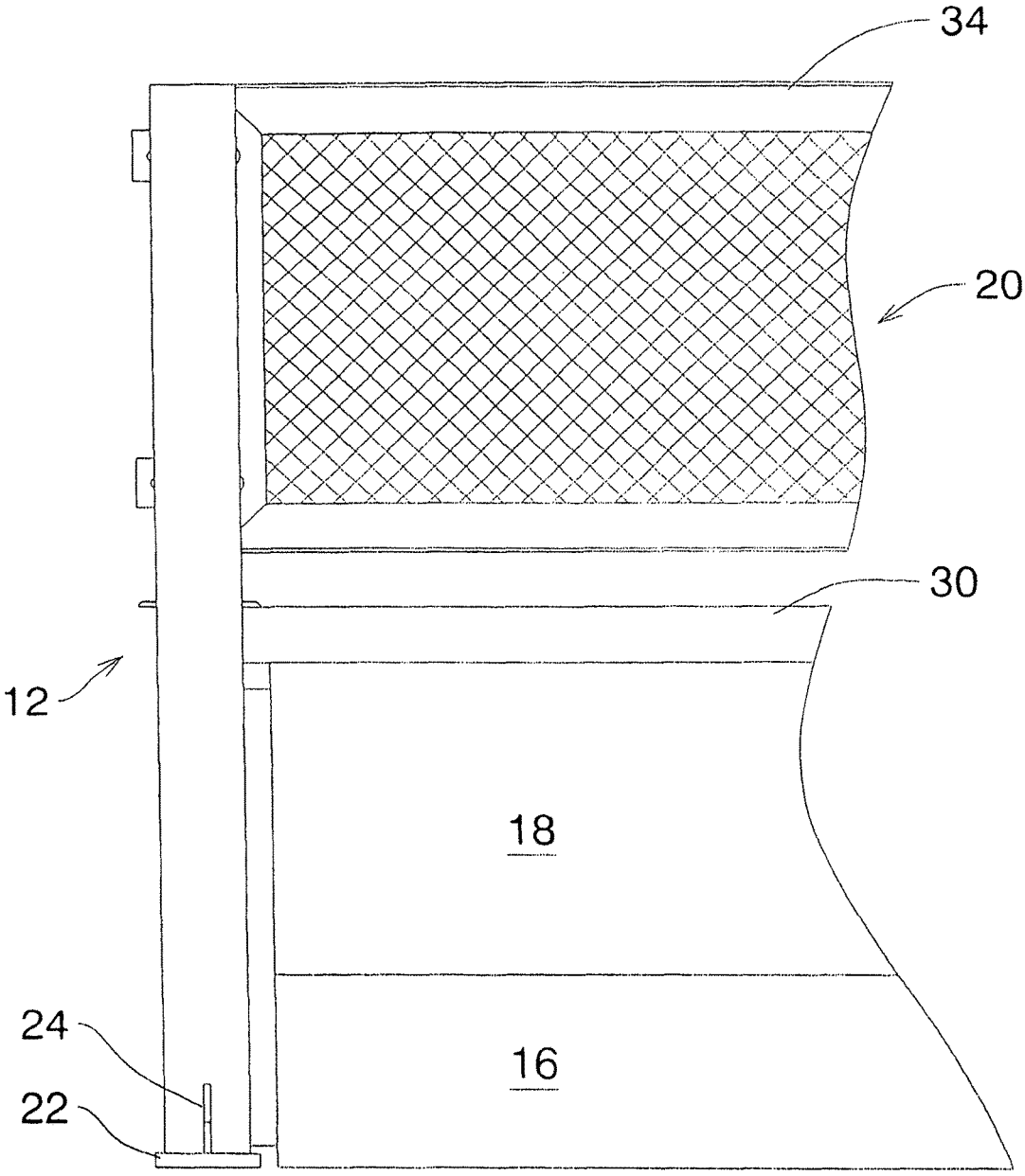
FIG. 2 is a side elevation of a fence post, and a precast concrete vehicle barrier member, and a personal barrier partly cut away.

As illustrated generally in FIG. 1, the invention is there shown embodied in a construction site barrier indicated generally as (10). The barrier comprises a plurality of upright post members (12), fastened to the ground at spaced intervals. Between the posts (12) there are precast concrete lower vehicle barrier members (14), typically formed of elongated precast concrete, and defining lower wide angled portions (16), and upper steeply angled portions (18). Such precast concrete vehicle barrier members are well known and are used in many countries. They provide in the lower portions, a means of deflecting the wheels of a vehicle, so that the vehicle may be redirected into a direction more or less parallel with the precast concrete barrier, and thereby less likely to spin or turn backwards, causing a major vehicle crash.

As is well known, the lower wide angled portions (16) flare outwardly in order to, as far as possible, deflect the wheels in the manner described above. The upper angled portion is more steeply angled. Such precast concrete barriers, known as "Jersey barriers," are widely used in the separation of highways in many countries. As a rule they have a standard length and a standard height.

Located generally above the precast concrete vehicle barrier members (14), there are personal barrier screen panels (20), typically, although not necessarily formed of a wire mesh material, permitting pedestrians to view the building site, whilst excluding entry. Referring now in more detail to the FIGS. 2-5, it will be seen that the posts (12) are of generally H-shaped transverse cross section (FIG. 4) throughout their length and are mounted on transverse base plates (22), and reinforced by gussets (24). The plates will typically be fastened to the ground. The H-shaped section configuration defines along the length of each post member, a central web (25), and side flanges (26) on either side of the web (25), and extending continuously from bottom to top.

The typical concrete vehicle barriers (14) are provided with steel connecting elements (28) (FIG. 5) at each end. These connecting elements are formed to interfit between the side flanges (26) of the vertical posts (12) and provide a secure means of maintaining the precast concrete vehicle barrier members in alignment.

In order to provide for further security, an intermediate transverse fence rail namely, channel, (30) (FIG. 3) is secured transversely, extending between posts (12) and normal to the axis of the posts (12), by means of L-shaped attachment brackets (32). The channel (30) is modular a has a length corresponding to the length of the concrete barriers and has side walls (31) which are dimensioned to make a fit around the top edges of the precast concrete vehicle barriers (14) (FIG. 1). The channel (30) is open downwardly and the two side walls (31) fit over and embrace the upper edges of precast concrete barriers (14)

In order to provide a personal barrier, extending above the vehicle barrier members (14), and above the channel (30), the invention further provides the screens (20). Screens (20) are typically formed of wire mesh, although they could be solid screens if desired. The screens (20) are formed with frames (34), of generally L-shaped sections, which are welded into a rectangular shape, and wire mesh material is supported within the frames (34).

Figure 3:
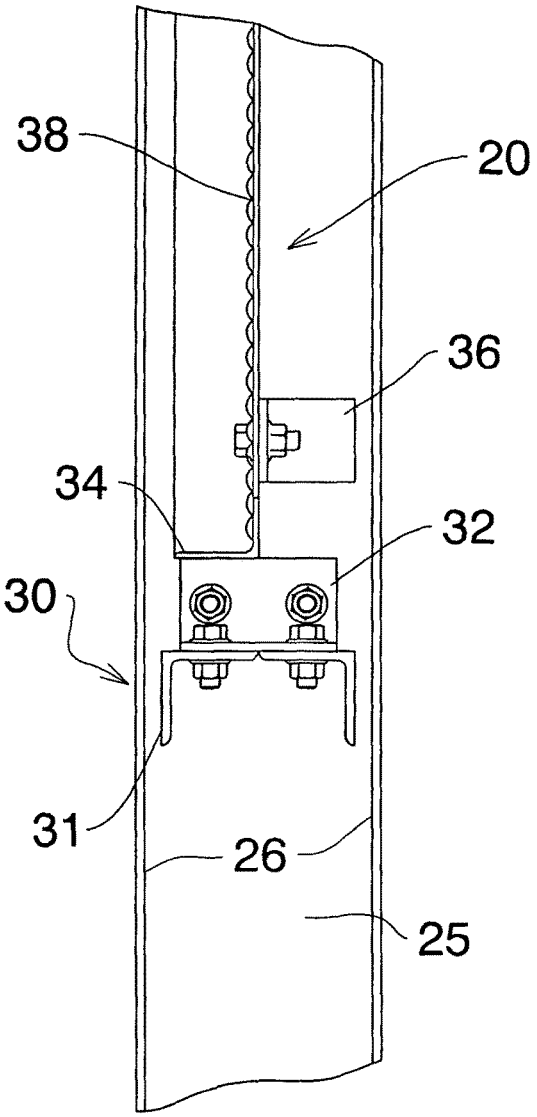
FIG. 3 is a section along the line of 3-3 of FIG. 2.
Figure 5:
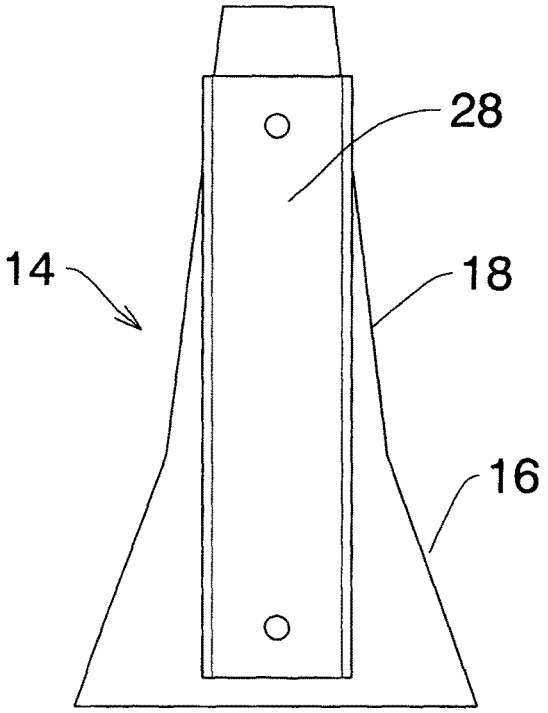
FIG. 5 is an end elevation of a typical precast concrete vehicle barrier, known as a "jersey" barrier.
Figure 4:
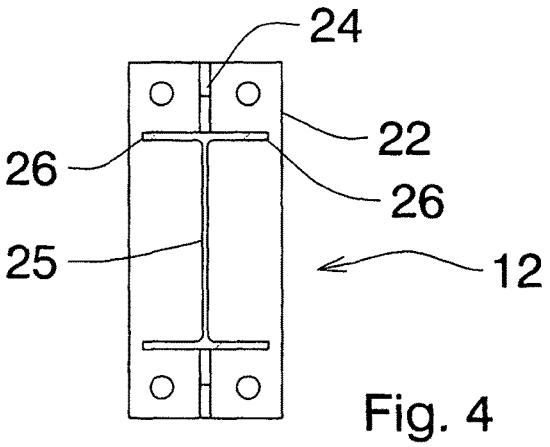
FIG. 4 is a section along the line of 4-4 of FIG. 3.

The frames (34) have a length corresponding to the length of the precast concrete vehicle barriers (14), so that they form a modular system and fit snugly between side flanges (26) of the adjacent upright posts (12), located between each of the ends of precast concrete barriers (14). They may be of any suitable height deemed necessary, in this case reaching an upper limit of around six feet from the ground, or about three feet above the edges of the precast concrete barriers (14). These dimensions are not critical and are given here merely by way of general guidance. The frames (34) are secured within side flanges (26) of the H-shaped sections of the posts (12) by L-shaped brackets as shown (FIG. 3). Mesh screen material (38) is secured within the frames (34).

It will be seen that by means of the invention, a modular prefabricated construction site barrier is provided, which may be erected around a Construction site, and when no longer required, may be dismantled and reused at another site. At the same time, the entire barrier provides protection against intrusion, both by vehicles and by personnel in an effective and yet aesthetically pleasing manner. The precast concrete vehicle barrier members, and the wire mesh personal barriers are both effective for their respective purposes and are also generally unsuitable for posting of bills, or graffiti, which are an unsightly addition to construction site barriers in many cases.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A combined pedestrian and vehicle barrier construction site fence system comprising:

a plurality of upright post members spaced apart, the members defining length and upper and lower ends, and each said post member having an H shaped transverse cross section from said upper end to said lower end throughout its length;

pairs of retention side flanges defined by said H-shaped cross section, on opposite sides of each of said post members, and extending from said upper end to said lower end;

base plates attached transversely to said lower ends of said post members adapted to stand on the ground;

pre cast concrete vehicle barrier members of predetermined modular length and height and defining predetermined upper edges;

end support connectors on each end of each said pre cast concrete vehicle barrier member inter-engageable between respective pairs of said side flanges on said post members an intermediate transverse fence rail of predetermined channel shape and of modular length extending between said post members on the upper edges of said pre cast concrete vehicle barrier members; said intermediate transverse fence rail forming a downwardly open channel fitting over and receiving said upper edges of said pre cast concrete vehicle barrier members, and, personal fence panels located between said post members, defining a predetermined modular width, and height and extending above said intermediate fence rails and above said pre cast concrete vehicle barrier members.

2. The combined pedestrian and vehicle barrier construction site fence system as claimed in claim 1 wherein said intermediate fence rail is secured to said upright post members by generally right angular brackets.

3. The combined pedestrian and vehicle barrier construction site fence system as claimed in claim 2 wherein the vehicle barrier members define a predetermined length, and wherein said personal fence panels comprise rectangular frames, formed with a length corresponding to the length of said pre cast concrete vehicle barrier members and fitting between respective upright post members, and generally L-shaped brackets securing said rectangular frames to said upright post members.

4. The combined pedestrian and vehicle barrier construction site fence system as claimed in claim 3, wherein the personal fence panels further comprise wire mesh material supported in said frames, permitting pedestrians to view the work on the construction site.

5. A combined pedestrian and vehicle barrier construction site fence system comprising ;

a plurality of upright post members spaced apart, each of said post members defining upper and lower ends, and having an H shaped transverse cross section throughout its length;

pairs of retention side flanges defined by said H-shaped cross section, on opposite sides of said post members;

base plates attached transversely to said lower ends of said post members adapted to be secured to the ground;

pre cast concrete vehicle barrier members of predetermined modular length and height and defining predetermined upper edges;

end support connectors secured to each end of each said pre cast concrete vehicle barrier member inter-engageable between respective pairs of said side flanges on said post members an intermediate transverse fence rail of predetermined modular length extending between said post members adjacent to the upper edges of said pre cast concrete vehicle barrier members; said fence rail forming a downwardly open channel fitting over said upper edges of said pre cast concrete vehicle barrier members, secured to said upright post members by generally right angular brackets and, personal fence panels located between said post members, defining a predetermined modular width, and height and extending above said intermediate fence rails and above said pre cast concrete vehicle barrier members; wherein said personal fence panels comprise rectangular frames, formed with a length corresponding to the length of said pre cast concrete vehicle barrier members and fitting between respective upright post members, and generally L-shaped brackets securing said rectangular frames to said upright post members, and wherein each post member defines in transverse cross section a central web, and two pairs of side flanges extending on opposite side of said web, for engaging said ends of said precast concrete barriers, and ends of said intermediate fence rail, and said frames of said personal panels.

* * * * *